US008365474B2

(12) United States Patent
McSweeney

(10) Patent No.: US 8,365,474 B2
(45) Date of Patent: Feb. 5, 2013

(54) BUILDING PANEL MODULE AND SPHERICAL SHELL

(76) Inventor: John Patrick McSweeney, Brookfield, CT (US)

( * ) Notice: Subject to any disclaimer, the term of this patent is extended or adjusted under 35 U.S.C. 154(b) by 0 days.

(21) Appl. No.: 12/932,031

(22) Filed: Feb. 16, 2011

(65) Prior Publication Data

US 2012/0204496 A1 Aug. 16, 2012

(51) Int. Cl.
*E04B 7/08* (2006.01)

(52) U.S. Cl. ..... 52/81.1; 52/81.4

(58) Field of Classification Search ..... 52/81.1, 52/81.4, 82, 80.1
See application file for complete search history.

(56) References Cited

U.S. PATENT DOCUMENTS

| | | | | |
|---|---|---|---|---|
| 3,296,755 | A * | 1/1967 | Chisolm | 52/81.4 |
| 4,092,810 | A * | 6/1978 | Sumner | 52/81.4 |
| 4,241,550 | A * | 12/1980 | Sumner | 52/81.4 |
| 4,531,333 | A * | 7/1985 | Huegy | 52/81.2 |
| 6,295,785 | B1 * | 10/2001 | Herrmann | 52/745.08 |
| 6,912,488 | B1 * | 6/2005 | Saebi | 703/1 |
| 2002/0059777 | A1 * | 5/2002 | Saebi | 52/745.07 |
| 2006/0117675 | A1 * | 6/2006 | Herrmann | 52/81.1 |
| 2007/0163185 | A1 * | 7/2007 | Morley et al. | 52/81.1 |
| 2010/0077674 | A1 * | 4/2010 | Johnson et al. | 52/81.1 |

FOREIGN PATENT DOCUMENTS

GB 2232695 A * 12/1990

* cited by examiner

*Primary Examiner* — Brian Glessner
*Assistant Examiner* — Brian D Mattei
(74) *Attorney, Agent, or Firm* — Peter Saxon

(57) ABSTRACT

Synclastic hollow core building panels are employed to form dome-like structures. The synclastic curve allows the panels to be lightweight, yet capable of carrying the weight of the structural loads. When combined, the panels create a sphere or a section of a sphere for enclosing space, with optional egress, skylight, and foundation portals incorporated into the structure without disturbing the spherical curvature of the interior or exterior surfaces. The spheres or sphere sections require no additional framing; the panels themselves are the frame. Workers with only the basic assembly skills can construct a sphere or sphere sections using these panels.

6 Claims, 15 Drawing Sheets

Fig#1
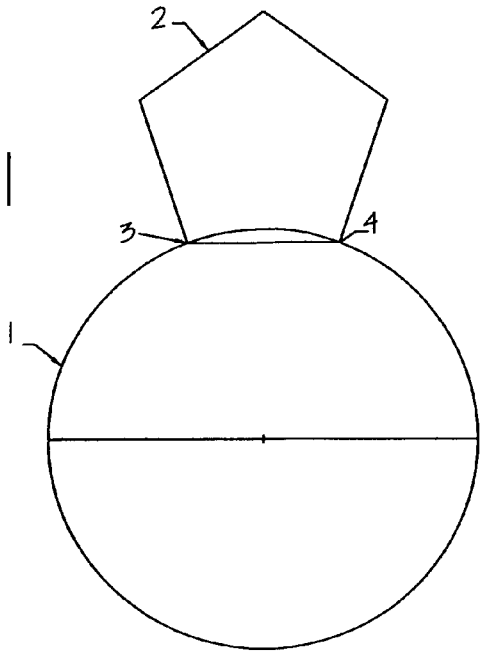
Fig#2
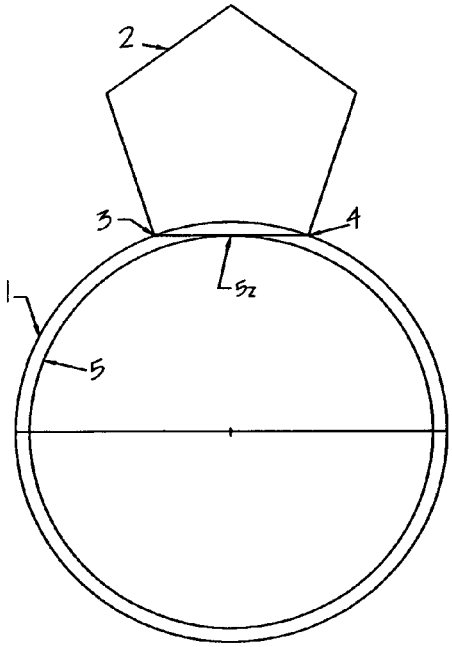
Fig#3
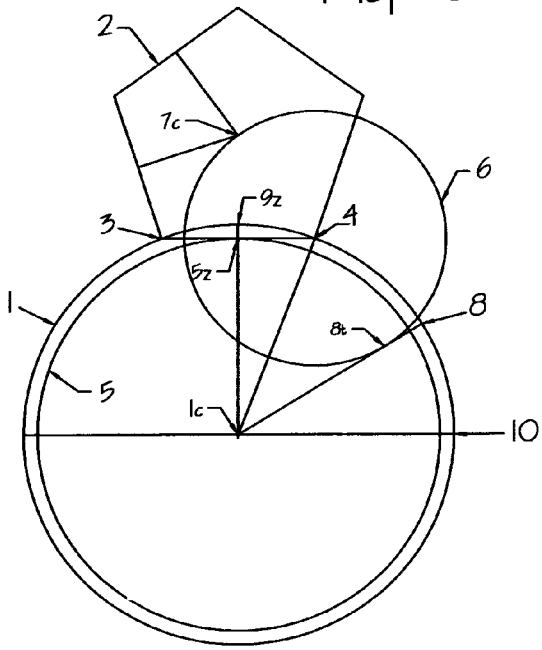

Fig # 4
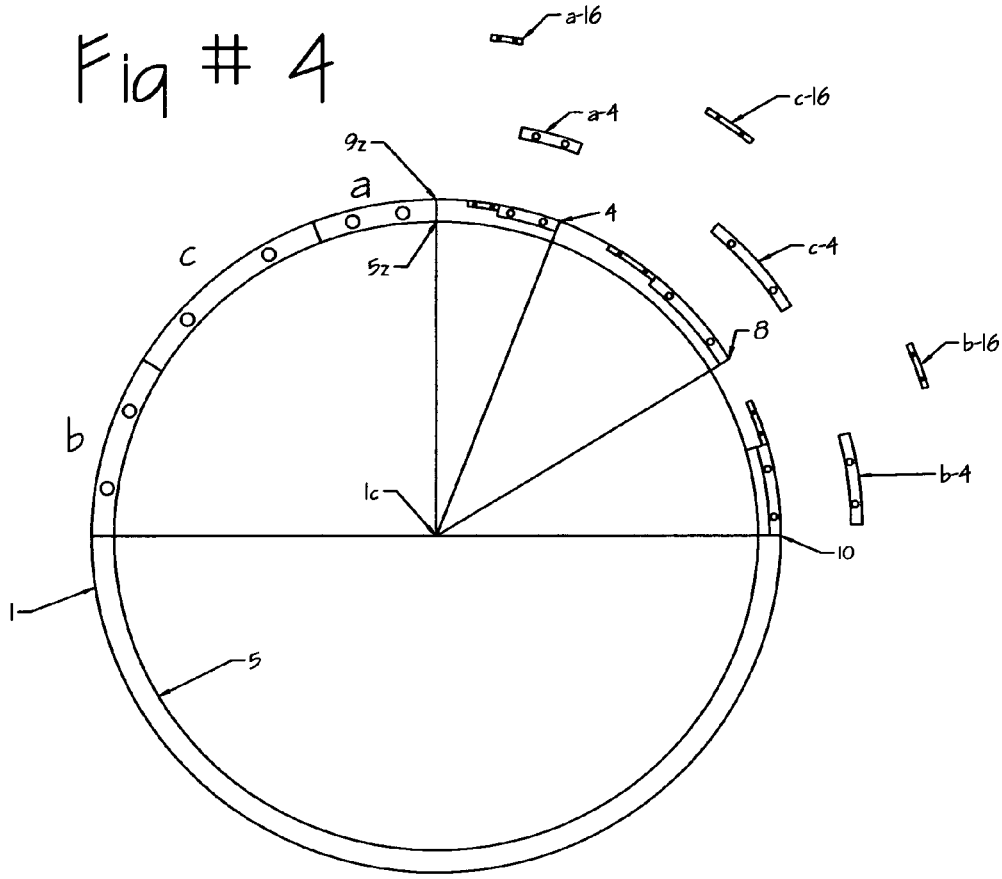
Fig # 5
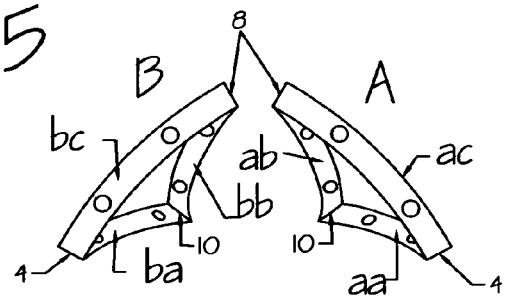

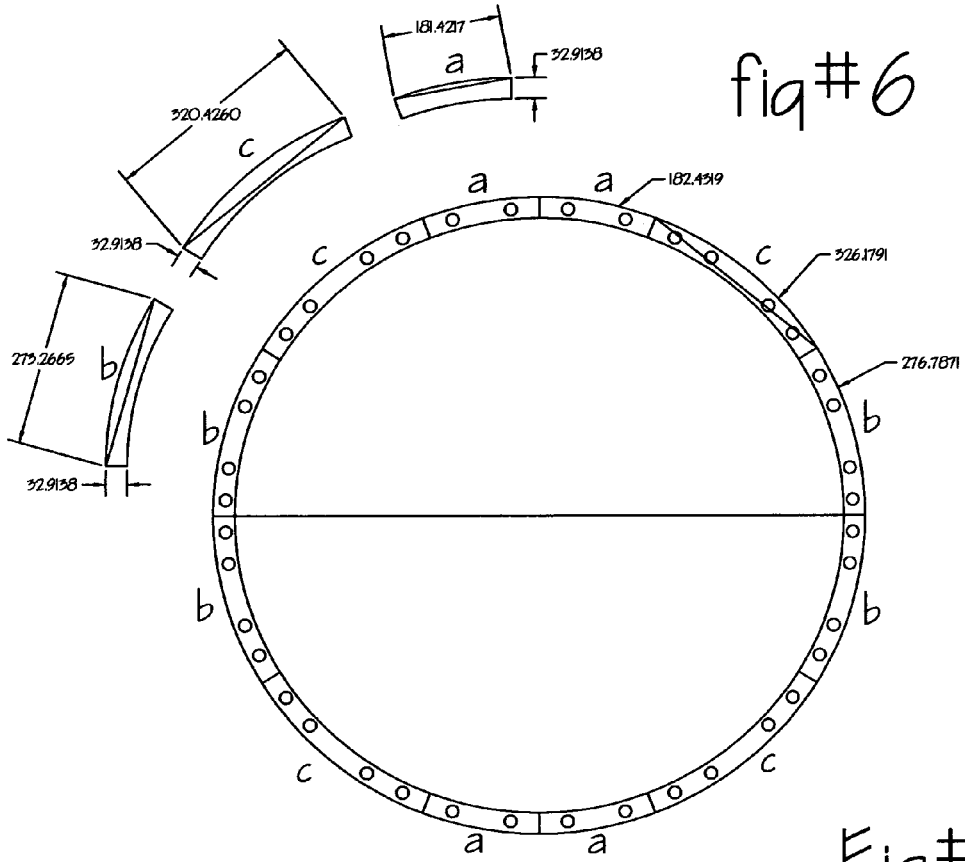
fig#6
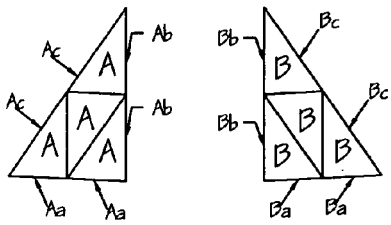
Fig#8
Fig#7
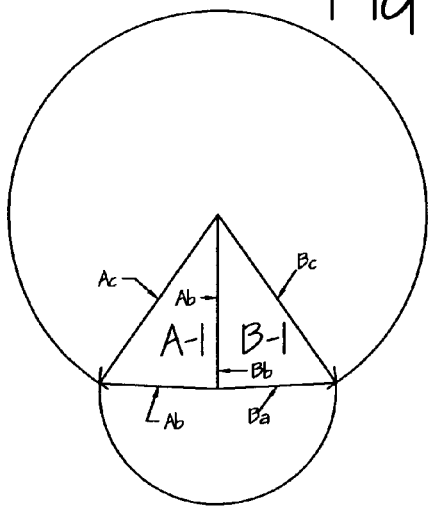

Fig#9
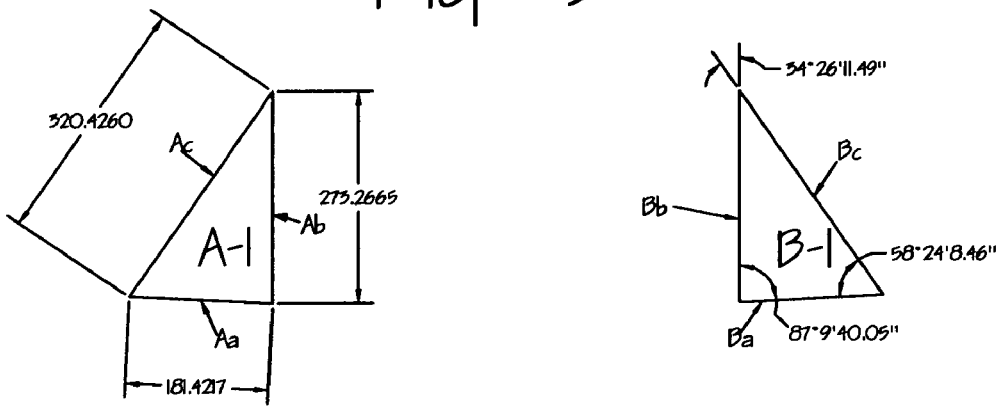
Fig#10
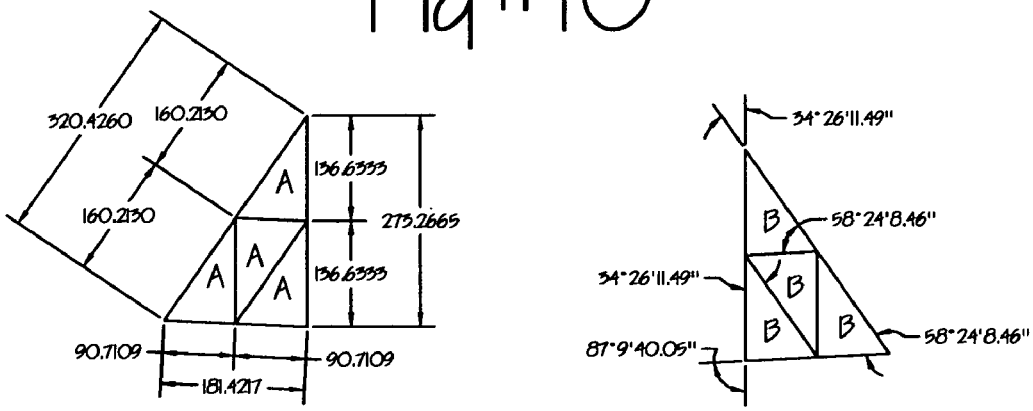
Fig#11
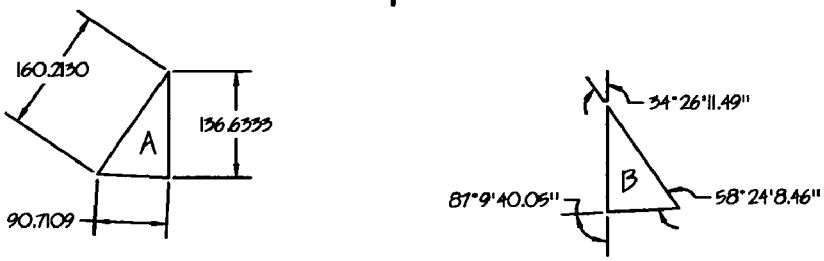

Fig#12
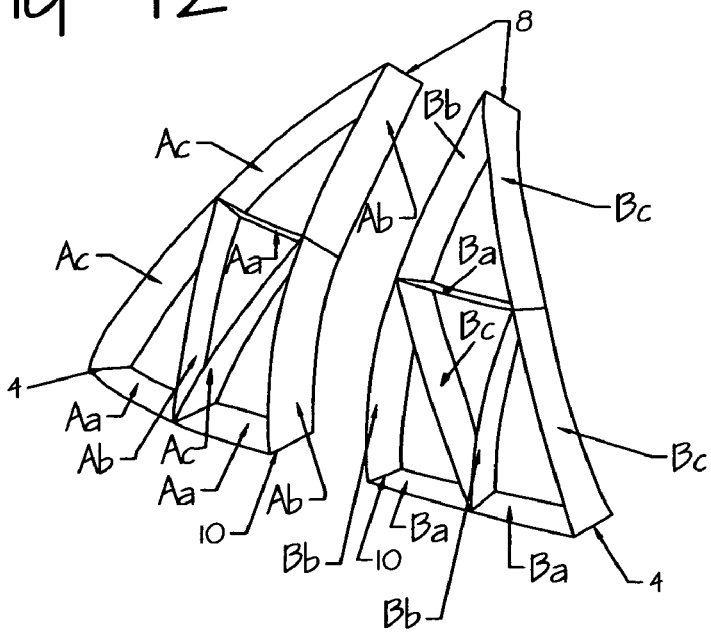
Fig#13
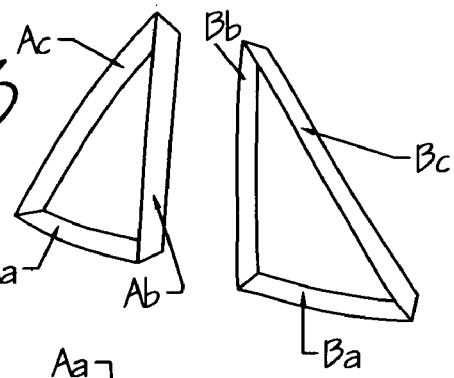
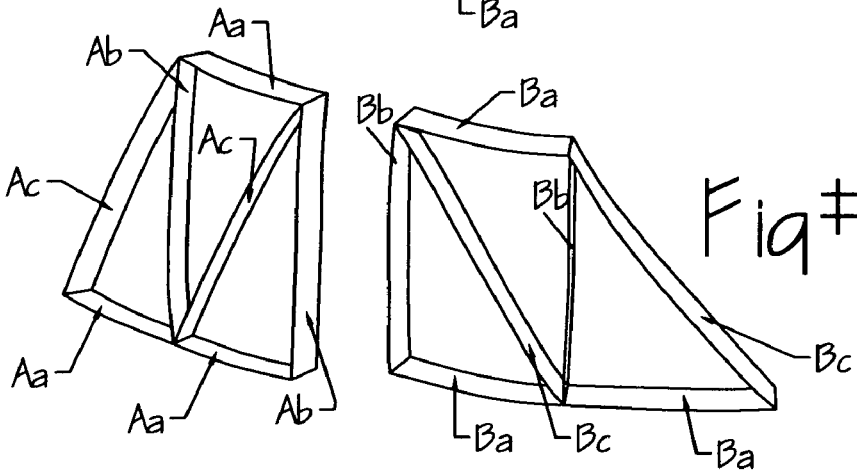
Fig#14

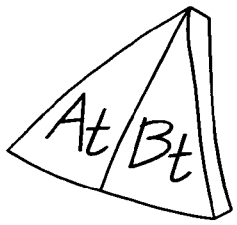
Fig#15
Fig#16
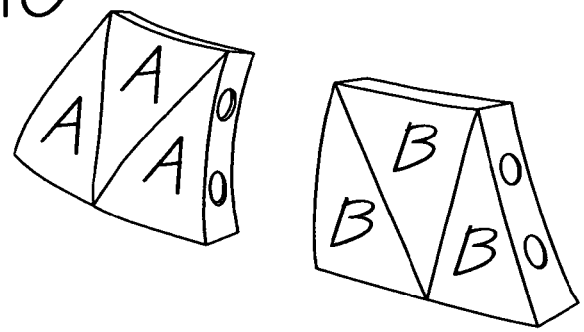
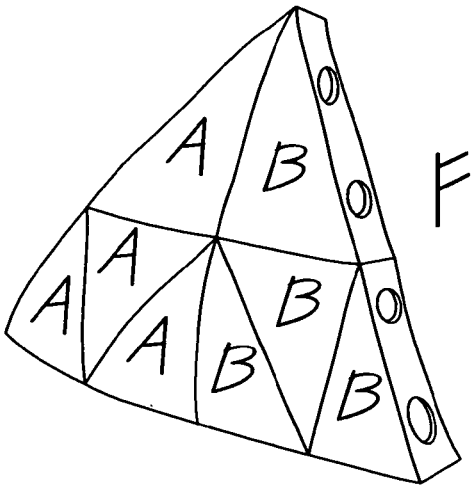
Fig#17

Fig#18
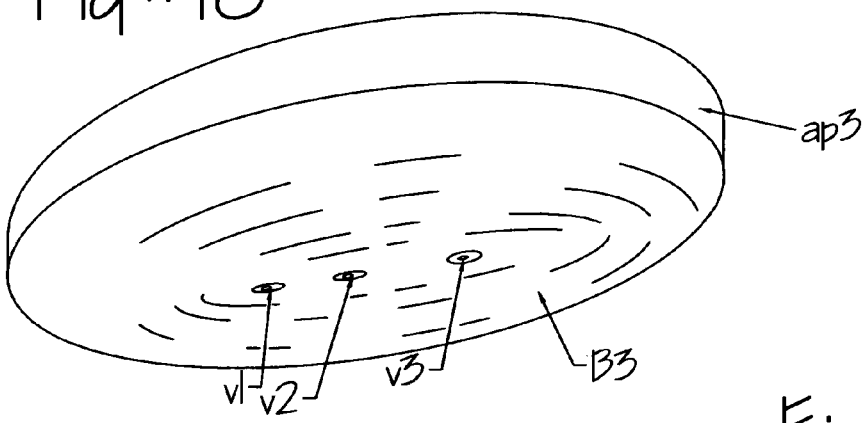
Fig#19
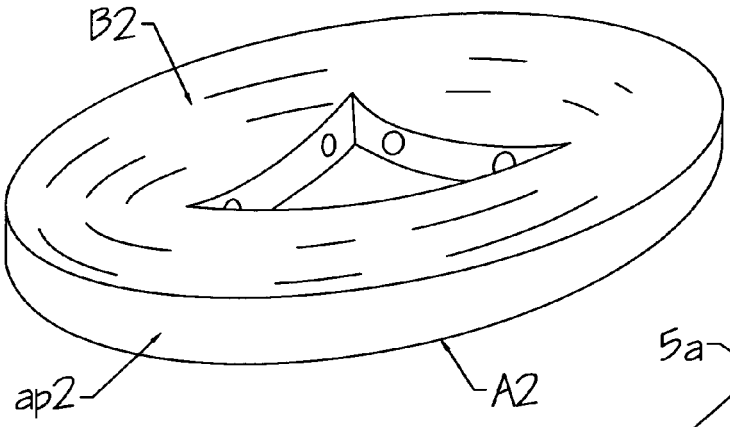
Fig#21
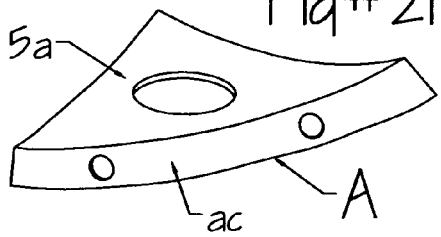
Fig#20
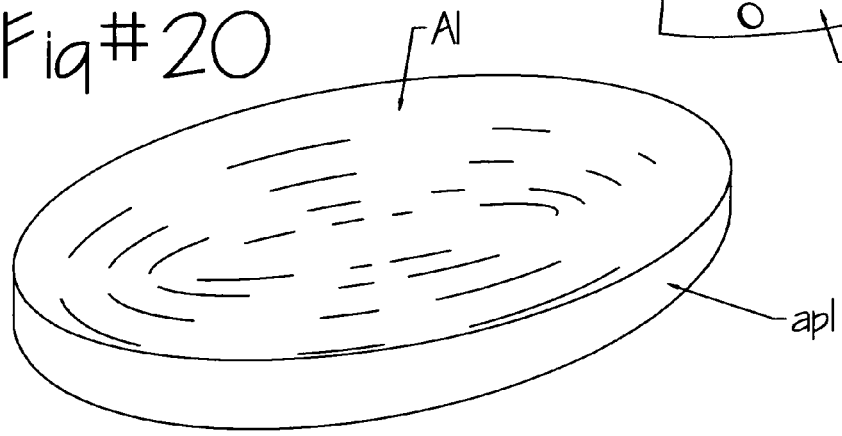

Fig#22
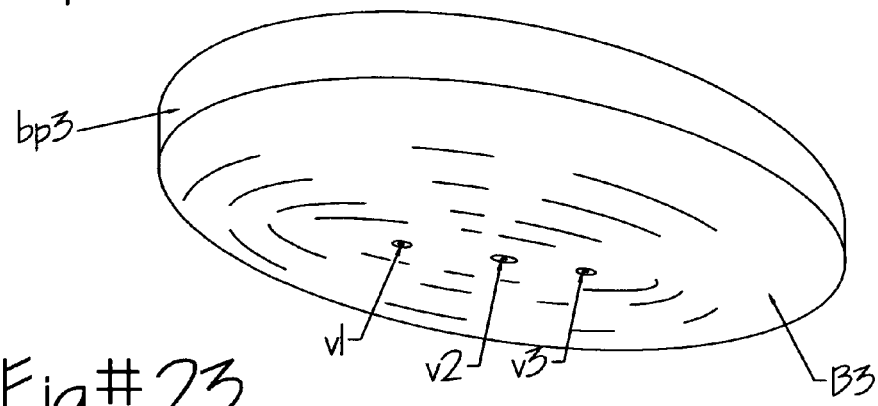
Fig#23
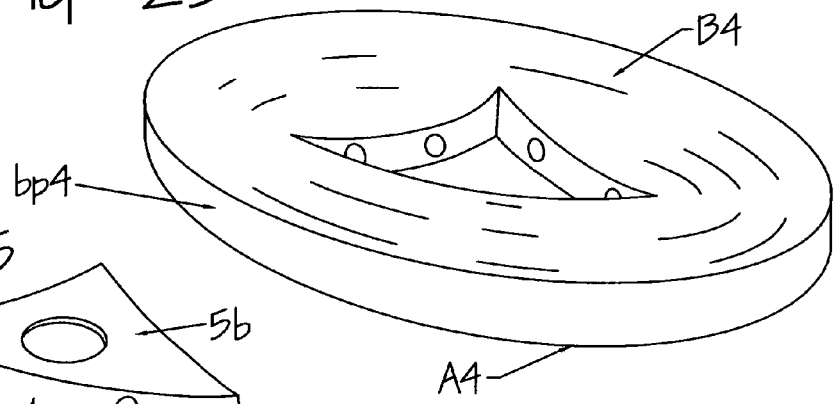
Fig#25
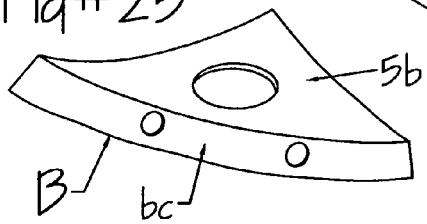
Fig#24
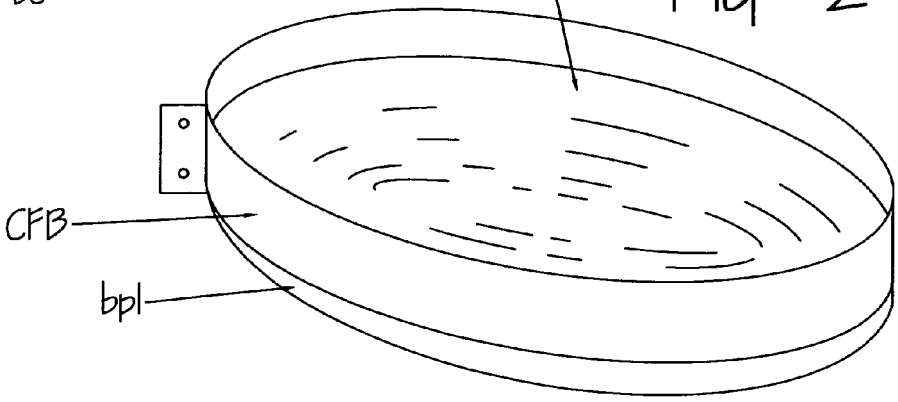

Fig#26
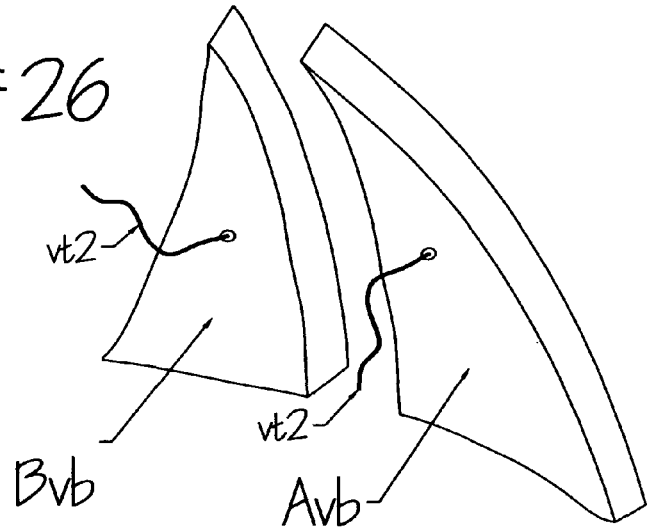
Fig#27
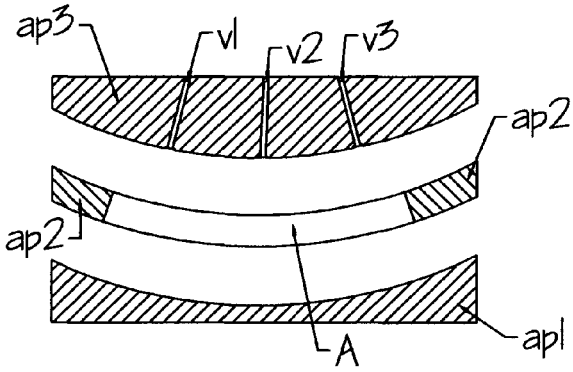
Fig#28
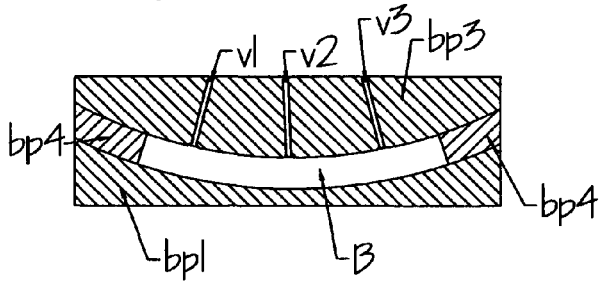

Fig#29
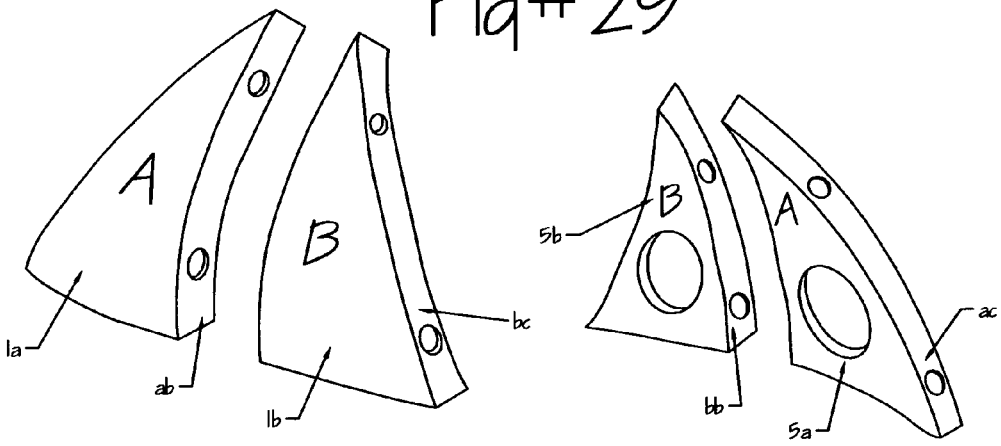
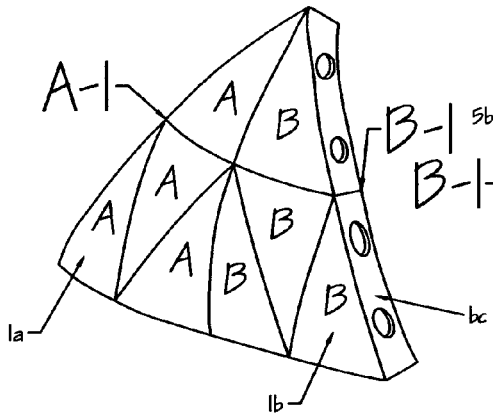
Fig#30
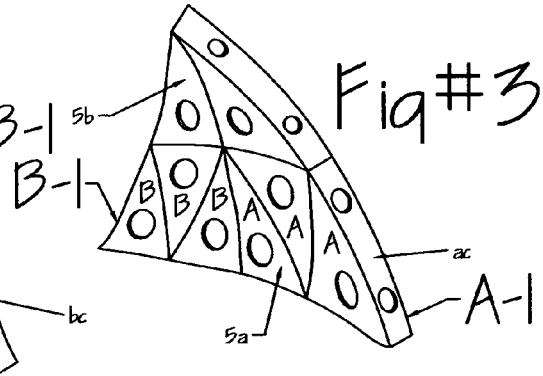
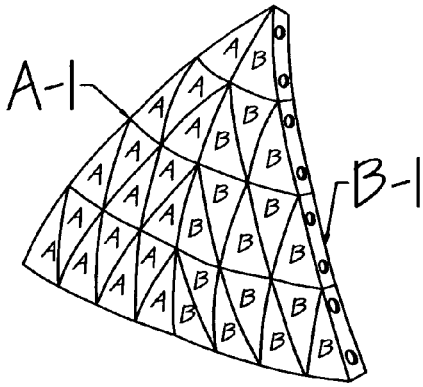
Fig#31
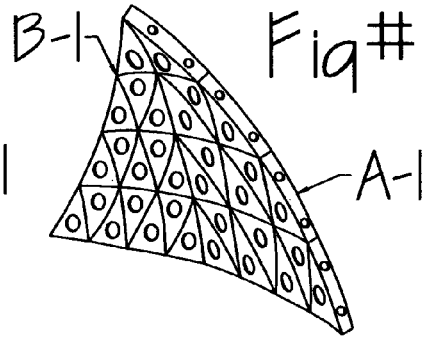

Fig#32
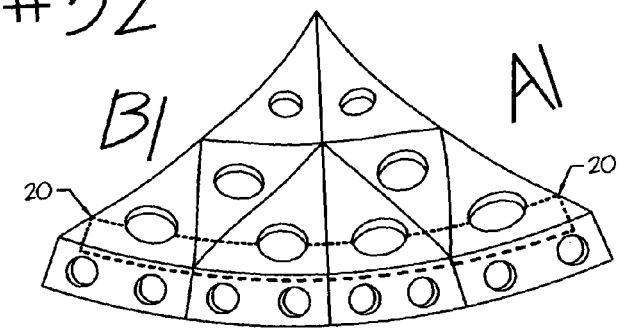
Fig#33
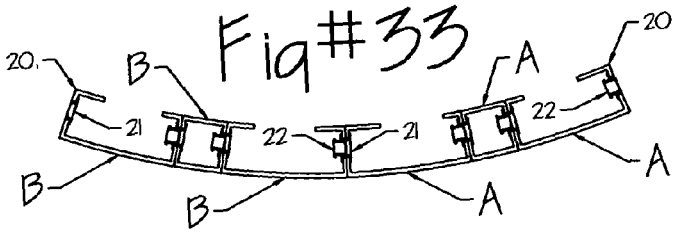
Fig#34
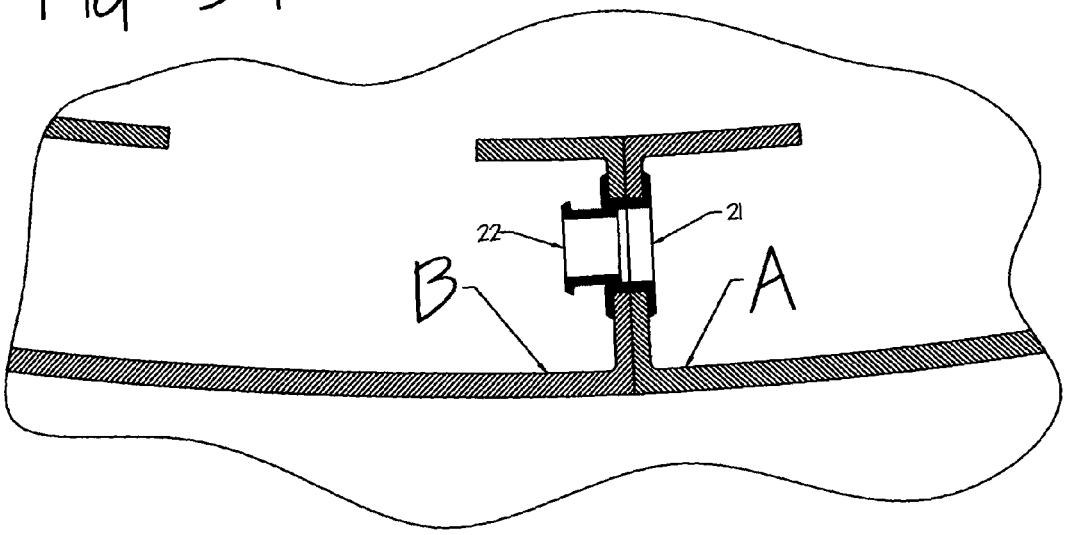

Fig#35
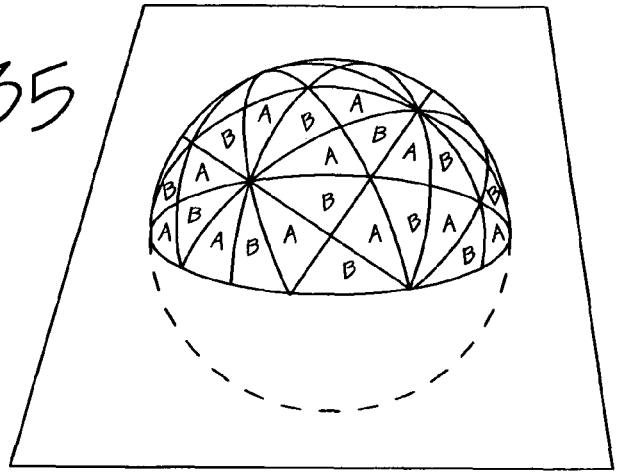
Fig#36
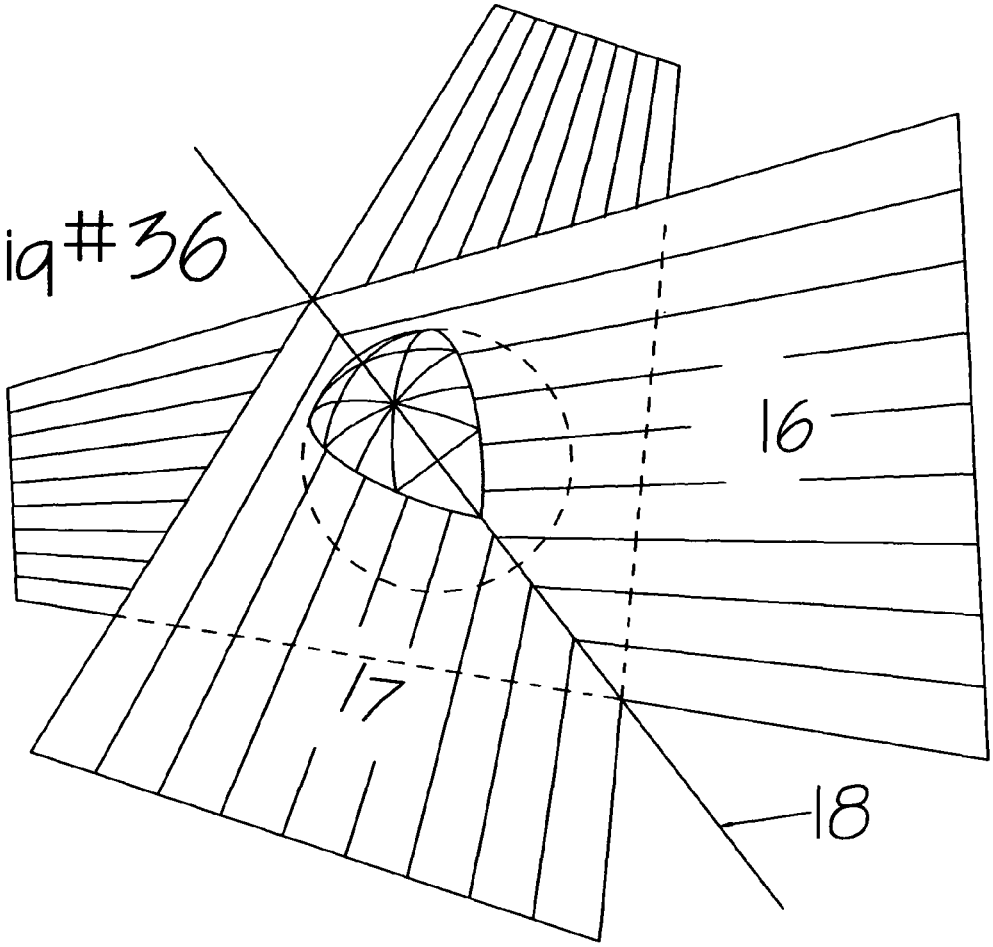

Fig#37
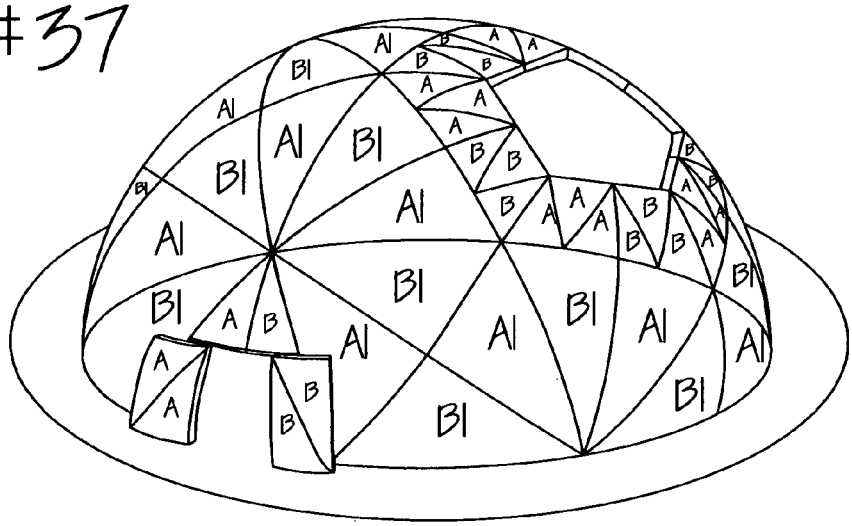
Fig#38
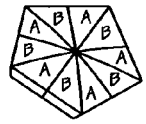
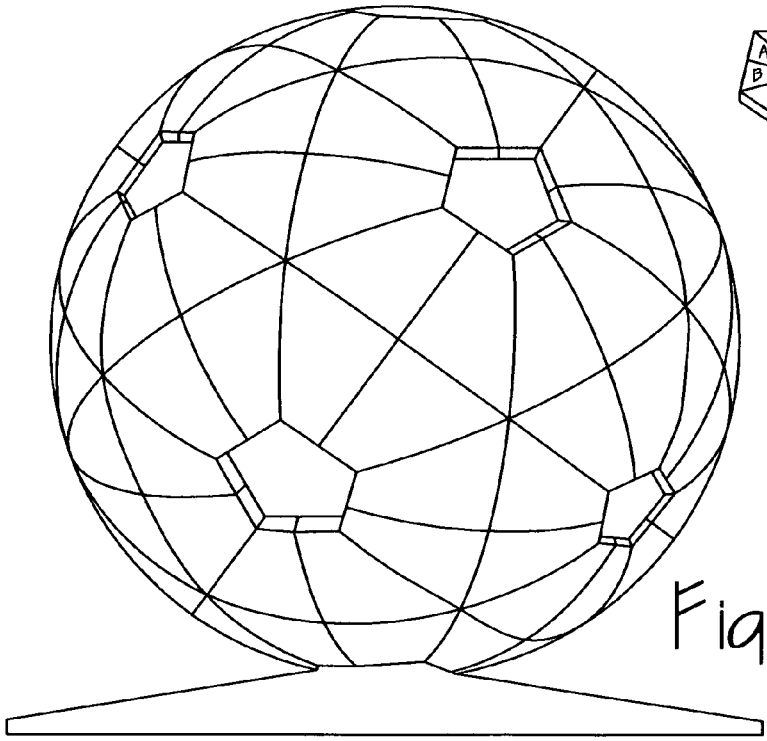
Fig#39

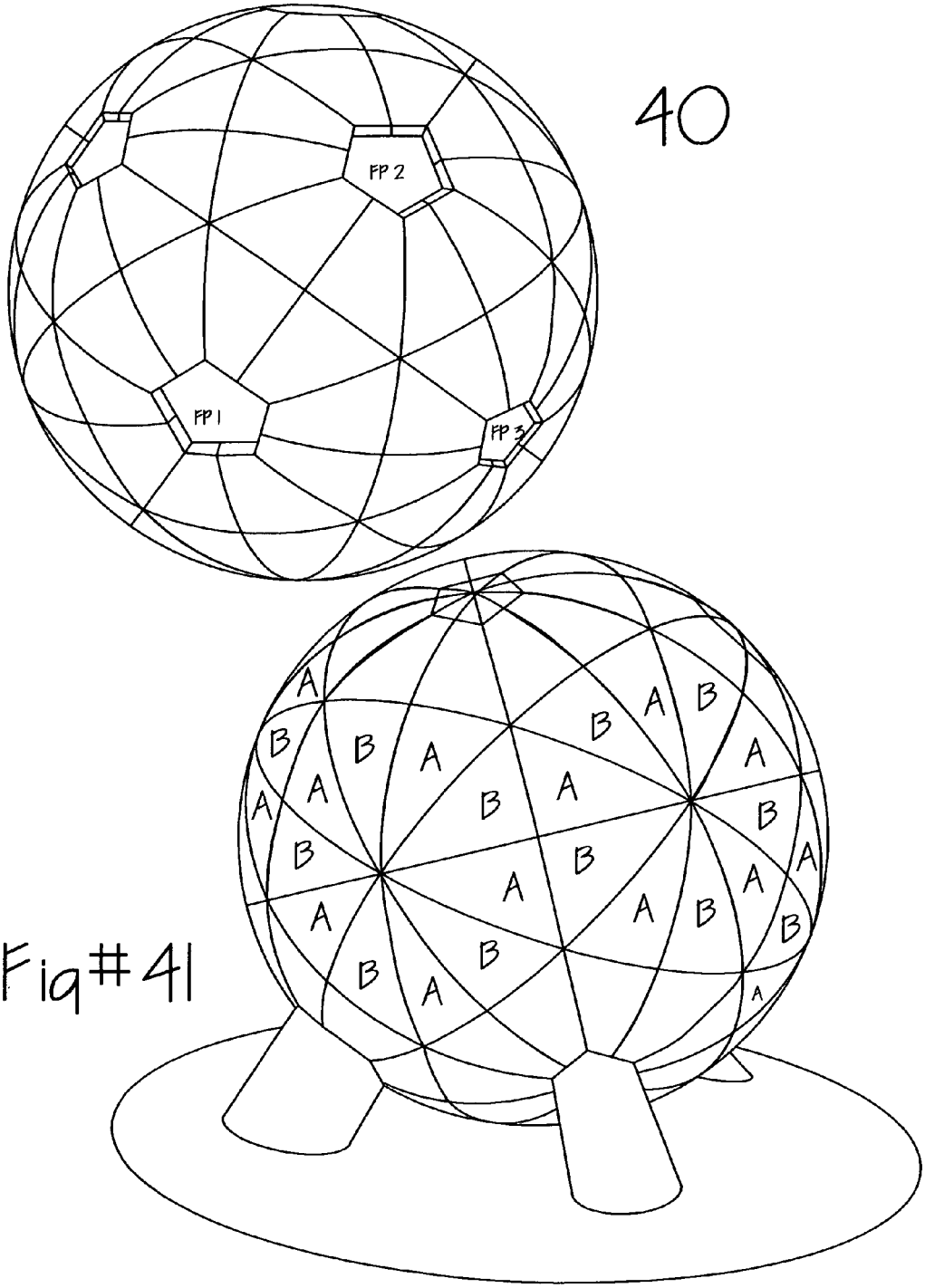
Fig#41

Fig#42
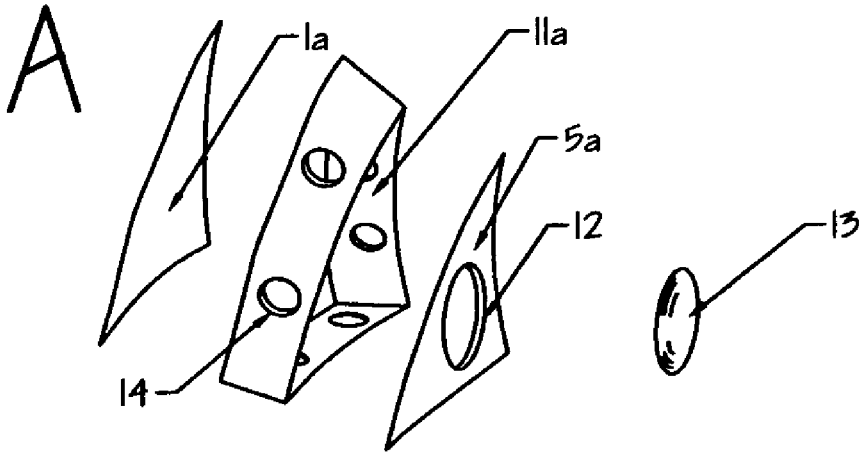
Fig#43
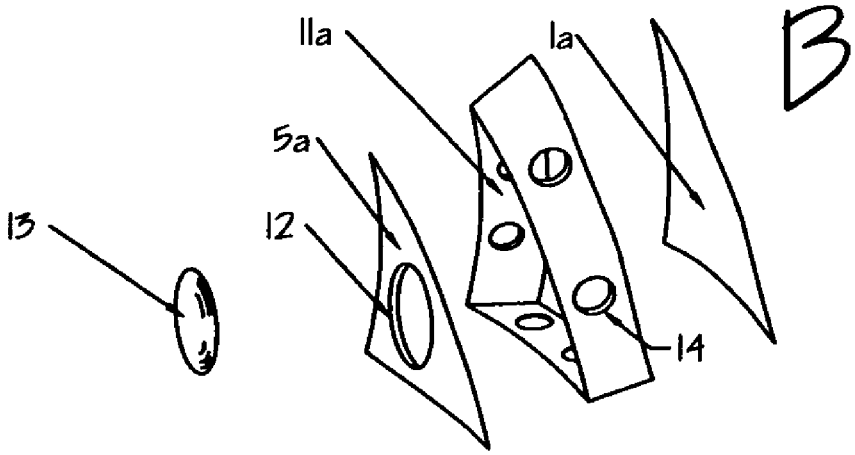

BUILDING PANEL MODULE AND SPHERICAL SHELL

BACKGROUND OF THE INVENTION

Field of the Invention

The present invention relates to a building panel used in the field of building construction; and, in particular, to a synclastic double hull arch truss panel adapted to be assembled into a spherical or dome-shaped structure and a method of making the same.

Domes can be used, inter alia, for human habitats in locations where extreme weather conditions exist and conventional structures are not suitable, such as artic and desert areas, or high wind terrains. Domes are also used for planetariums, observatories, greenhouses, and capping grain silos. They can make an architectural statement in cities, corporate parks, atriums, houses of worship, government buildings, science and university buildings, among others.

Spheres can prove useful where great pressure is exerted on the outer surface of the structure, as in underwater habitats, or subterranean structures. In the vacuum of space, spheres or dome-like structures can serve as orbiting space platforms, but are not limited to these conditions.

Sections of a sphere, when used for constructing three quarter spheres, hemispheres, or quarter spheres typically connect to conventional buildings structures at 180° or 90° on flat roof tops, building side walls, inside and outside right angle corners and the like to expand interior open space and make an architectural statement.

Previously, spherical or dome like structures were generally built from prefabricated panels supported on a framework. Such panels were typically flat triangles or tetrahedrons in shape and were assembled about a central axis. Such structures employing flat panels required a plurality of different shapes in order to construct a spherical structure, thus requiring complex fabricating steps which have proven very costly. In addition, such flat panels require framing, support units and finishing of interior surfaces when assembling into a final structure. Proposals have been made to use flat panels supported on a frame and interconnected with hubs for proper structural support. Such framing must carry the load of the interior and exterior panels, which limit the load carry strength of the structure. Typical prior art patents illustrating such different panel shapes, framing and/or hubs includes U.S. Pat. Nos. 2,736,072; 3,026,651; 3,296,755; 3,977,138; 4,009,548; 4,330,969; and 5,628,154.

SUMMARY OF THE INVENTION

The present invention includes panels that will provide spheres, three-quarter spheres, hemispheres, quarter spheres, eighth spheres and the like. To build a sphere structure of the invention two basic, synclastic panels, Panel A and Panel B are generally employed that can be pre-cast or molded in structural plastic, carbon fiber, fiberglass, polycarbonate or other such structural materials. The panels, due to their synclastic curves, are much stronger than flat panels made of the same material. The inventive panels are designed to be used together in building modules. A plurality of these panels will provide a sphere, or a section of a sphere that is lightweight and, at the same time, extremely strong.

The panel and module shapes are based on a dodecahedron, or, more particularly, a disdyakis triacontahedron, that has been projected onto a sphere forming great circles. Since only two types of panels need to be manufactured, cost is reduced.

Since the panels do not require additional framing, then labor costs, as well as shipping and storage costs are reduced. In addition, a synclastic sphere is quite aesthetically pleasing, due to the smooth, uninterrupted curved surface. Synclastic curves are curved toward the same side in all directions. Workers with only the basic assembly skills can construct a sphere or hemisphere using these panels.

As defined herein the term panel means a synclastic, double-hull, arch truss panel. The outer surface of the panel is the outer hull; the inner surface of the panel is the inner hull.

Each of the structural building panels is a one piece, synclastic double-hull, arch truss panel, triangular in shape, that can be pre-cast or molded from various materials. Such panels are self-supporting panels that do not require any kind of additional framing for building spheres, hemispheres or the like; the panels themselves are the frame. Both the exterior hull and interior hull of these panels can be pre-finished on a factory assembly line. The arch trusses, which are integrated into the panel along the edges of the hulls, connect the outer hull to the inner hull seamlessly, to provide a hollow core inside the panel for the inclusion of mechanicals and insulation, as will as for providing a surface for connecting the panels together through the arch trusses. This feature makes the panels more cost-effective then other systems, which require separate framing and more assembly at the construction site.

The basic components of both panels A and B generally include five sides: a synclastic triangular outer hull, a synclastic triangular inner hull, and three arch trusses. The hulls are connected by the arch trusses, typically integrally incorporated seamlessly into a casting, to form a hollow core panel. Each panel has arch truss sides of different lengths, designated a, b, and c, which lie on a theoretical geodesic plane that passes through the center axis of the assembled sphere. This feature allows the panels to fit together as building modules. These building modules are assembled symmetrically only on a theoretical geodesic plane along their arch truss edges.

When skylight portals, egress portals, and sphere foundation footing portals are required in the structure, Panels A and B are substituted at the required locations by transparent or translucent panels for skylight portals, hinge, pivoting, or sliding panels for egress portals and reinforced foundation footings for the sphere foundation portals.

The hulls or panel surfaces disperse the load of the structural weight, synclastically. The synclastic curve of the outer and inner hulls carries the load of the structure, thereby dispersing the weight evenly throughout each panel, which keeps the entire structure in compression. The panel trusses, which connect the inner hull to the outer hull seamlessly, serve as spacers between the hulls. Each panel is designed to be cast as one piece. After casting is complete, access holes are cut into the trusses and the inner hull, so that if desired, insulation and/or mechanicals can be installed inside the hollow core of the panel; that is between the inner and outer hulls, at the factory.

The arch trusses serve three functions: They act as spacers between the outer hull and the inner hull for running mechanical systems such as ventilation, electrical, fluid supplies and returns. They bond the outer hull to the inner hull seamlessly to form one hollow core, synclastically curved, integrated unit. They supply the surface area necessary for connecting the panels together. The panels themselves perform the function of a conventional frame; therefore, the structure does not require separate framing. If a panel is damaged, it can be replaced without endangering the integrity of the structure.

A building panel of the invention adapted to form an element of a dome structure comprises: a synclastic triangular outer hull; a synclastic triangular inner hull sharing the same axis as the outer hull; and a supporting arch truss structure sandwiched therebetween and connecting a periphery of the inner hull to a periphery of the outer hull to provide a hollow core, wherein respective sides of the arch truss structure are of different lengths which lie on a plane passing through a center axis of the dome structure.

A building module adapted to form an element of a dome structure comprises: first and second symmetric building modules, each said building module comprising a synclastic triangular outer hull; a synclastic triangular inner hull sharing the same axis as the outer hull; and a supporting arch truss structure sandwiched therebetween and connecting a periphery of the inner hull to a periphery of the outer hull to provide a hollow core, wherein respective sides of the supporting arch truss structure are of different lengths which lie on a plane passing through a center axis of the dome structure and wherein the first and second building modules are joinable along congruent sides of the respective arch trusses.

In one aspect a dome structure comprises a plurality of joined triangular shaped building modules, each building module comprising a set of four building panels. Module A-1, containing four A panels and module B-1, containing four B panels, said building modules which are mirror images of each other, each said building panel A and B comprises (a) a synclastic triangular outer hull, (b) a synclastic triangular inner hull sharing the same axis point as the outer hull and (c) a supporting arch truss structure sandwiched therebetween and connecting a periphery of the inner hull to a periphery of the outer hull to form a hollow core, wherein respective sides of the supporting arch truss structure are of different lengths which lie on a plane passing through a center axis of the dome structure, wherein each said pair of building modules are joined along congruent sides of the respective arch trusses of the same length.

The invention in another embodiment includes two building modules, each building module comprising a set of sixteen building panels. Module A-1, containing sixteen A panels and module B-1 containing sixteen B panels each panel being a one piece molded or cast structural panel, having a synclastic triangular shape. Panels A and B are symmetrical mirror images of each other along their arch truss edges. The two basic building modules A-1 and B-1, can be placed together along their corresponding arch truss edges to form a module pair. Thus, module A-1 connected to its mirror image, module B-1, produces a two-part symmetrical pair that serves as a building module suitable for assembly with similar building modules. For example, thirty A-1 modules together with thirty B-1 modules will complete a hemisphere, while sixty A-1 modules together with sixty B-1 modules will complete a sphere.

BRIEF DESCRIPTION OF THE DRAWINGS

In the drawings the arch truss sides of the panels are labeled with two letters; the first letter indicates the panel to which the arch truss belongs and the second letter indicates the arch truss side of the panel. For example, aa or Aa represents panel A, arch truss side a.

FIG. 1 is a representation of a great circle with a regular pentagon at the top;

FIG. 2 is a drawing showing the great circle of FIG. 1 with an inner arc and outer arc of the arch trusses;

FIG. 3 is a drawing showing radial lines of the arch trusses;

FIG. 4 is a geometric drawing showing the development of the three basic arch trusses, arch truss a, arch truss b, and arch truss c as well as arch truss a-4, b-4, c-4 and a-16, b-16, c-16, on the great circle;

FIG. 5 is a perspective drawing of arch truss triangle (a, b, c) for panel B, and arch truss triangle (a, b, c) for panel A;

FIG. 6 is a geometric drawing showing the ratio of the arch trusses arc cord lengths and arc lengths (a, b, c) for module A-1, and module B-1, as well as their placement on a geodesic plane of the sphere;

FIG. 7 shows the formation of the arch truss triangles, where cords (a, b, c) of the great circle form triangle (a, b, c) for module A-1 and a mirror image triangle (a, b, c) for module B-1;

FIG. 8 shows four A triangles and four B triangles, forming an A-1 triangular module and a B-1 triangular module from the arc cords (a, b, c) of the great circle;

FIG. 9 shows the ratio of the arc cord lengths of the sides of the arch truss triangle A-1, mirror image arch truss triangle B-1, and the dihedral angles of arch truss triangle B-1, which are the same dihedral angles as triangle A-1;

FIG. 10 shows both the dihedral angles and the ratio of the arc cord lengths of triangle module A-1 and mirror image triangle module B-1,and the placement of triangles A and triangles B into modular form;

FIG. 11 shows the dihedral angles and the ratio of the arc cord lengths of panel A and mirror image panel B;

FIG. 12 is a perspective drawing which shows a grouping of four arch truss triangles A with sides (Aa, Ab, Ac) and mirror image of four arch truss triangles B with sides (Ba, Bb, Bc) showing modular formation;

FIG. 13 is a perspective drawing which shows the arch truss triangle A with sides (Aa, Ab, Ac) and mirror image arch truss triangle B with sides (Ba, Bb, Bc);

FIG. 14 is a perspective drawing showing three A arch truss triangles with sides (Aa, Ab, Ac) and mirror image of three B arch truss triangles with sides (Ba, Bb, Bc), FIG. 15 is a perspective view of panel templates (At) and (Bt) as a pair showing their mirror image symmetry;

FIG. 16 is a perspective drawing showing three A panels together forming a trapezoidal module and mirror image symmetry to three B panels together forming a trapezoidal module;

FIG. 17 is a perspective drawing of panels A and panels B in modular pairs showing their mirror image symmetry;

FIG. 18 is a perspective view of casting plate ap3 showing its convex bottom surface and vacuum ports;

FIG. 19 is a perspective view of casting plate, ap2 showing its concave top surface with an empty cavity for casting panel A;

FIG. 20 is a perspective view of casting plate, ap1 showing its concave top surface;

FIG. 21 is a perspective top view of panel A;

FIG. 22 is a perspective view of a casting plate, bp3 showing its convex bottom and vacuum ports for casting panels;

FIG. 23 is a perspective view of casting plate, bp4 showing its concave top surface and the empty cavity for casting panel B;

FIG. 24 is a perspective view of casting plate, bp1 showing a casting form band CFB around its circumference;

FIG. 25 is a perspective view of panel B showing an arch truss edge and interior hull;

FIG. 26 is a perspective view of panel vacuum bladders with vacuum tubes connected for use in the casting molds of B panels and A panels;

FIG. 27 is a sectional view of three casting plates in an open position with vacuum ports and showing the cavity for panel A;

FIG. 28 is a sectional view of three casting plates in a closed position with vacuum ports and showing the cavity for panel B;

FIG. 29 is an exterior and interior perspective view of panel A and panel B illustrating exterior and interior hull surfaces and arch truss sides;

FIG. 30 is an exterior and interior perspective view of a four in one A1-module of A panels and a four in one B1-module of B panels together as building modules, to illustrate their symmetry;

FIG. 31 is an exterior and interior perspective view of a sixteen in one A1-module of A-panels and a sixteen in one B1-module of B-panels;

FIG. 32 is a perspective view of modules B1, A1 as a modular pair, showing sectional slice 20 as a dashed line section;

FIG. 33 is sectional slice cut away 20 showing sectional slice through B panels and A panels with threaded grommet connectors 21 and 22 in truss access holes;

FIG. 34 shows a close up view of how the panels are connected with grommet connector 21 and 22 through the arch truss access holes;

FIG. 35 is a perspective view of a theoretical geodesic plane passing through the center of a sphere on a geodesic line;

FIG. 36 is a perspective view of three theoretical geodesic planes (16, 17 and 18) passing through the center of a sphere on geodesic lines, geodesic plane (18) is represented as a strait line;

FIG. 37 is a perspective view of a geodesic hemisphere showing A panels and B panels used as egress portal and showing an open skylight portal;

FIG. 38 shows five panel pairs joined to form a portal;

FIG. 39 shows a geodesic sphere supported on one footing portal;

FIG. 40 shows a geodesic sphere with three footing portals, FP1, FP2 and FP3, viewed from below;

FIG. 41 shows the geodesic sphere of FIG. 40 supported through the three footing portals.

FIG. 42 is a exploded perspective view of panel A, showing its basic compositional makeup;

FIG. 43 is an exploded perspective view of panel B showing its basic compositional makeup.

DETAILED DESCRIPTION OF THE INVENTION

As shown in FIGS. 9, 12, 17, 30, 31 and 32, Panel module A-1 has a synclastic outer hull, a synclastic inner hull and three arch truss sides with dihedral angles, angle bc=34°26'11.49", angle ac=58°24'8.46", and angle ab=87°9'40.05". As shown in FIG. 6, the arch truss arc length ratios of the outer hull arc curve are: a=182.4319, b=276.7871, and c=326.1791 respectively, and the radial line length between the outer hull and inner hull is in direct proportion to the radius of the outer hull and radius of the inner hull. Also in FIGS. 9, 12, 17, 30, 31 and 32, Panel module B-1 has a synclastic outer hull, a synclastic inner hull and three arch truss sides with dihedral angles, angle cb=34°26'11.49", angle ac=58°24'8.46", and angle ab=87°9'40.05". Panel module B-1 arch truss arc length ratios of the outer hull arc curve are the same as Panel module A-1; a=182.4319, b=276.7871, and c=326.1791 respectively, and the radial line length between the outer hull and inner hull is in direct proportion to the radius of the outer hull and radius of the inner hull.

To make panel templates; first the size of the sphere or dome structure is selected, then the dimensions of panel modules A-1 and panel module B-1 are determined, once this is done, panel template (At) and panel template (Bt) can be sized to (.25) of panel module A-1 and panel module B-1.creating (A-1 module-4) and (B-1 module-4). this is done by bisecting arch trusses (a, b, c) and increasing the inner hulls radial arc to that of (0.5) of the radial line segment of the arch trusses enabling the creation of four A panels which fit into one A-1 module and four B panels that fit into one B-1 module. For very large geodesic domes this process can be repeated on A panels and B panels to keep the panel size manageable, as in a (A-1 module-16) and (B-1 module-16) in which 16 A panels and 16 B panels are used in A-1 modules and B-1 modules. This can be better understood when viewing FIGS. 4-12, 29-31. Panel template At and Bt are used in the process of casting panels A and B. Arch truss triangle A with sides a, b, c and mirror image arch truss triangle B with sides a, b, c, which share (1) the same dihedral angles, and (2) the same arc length ratios of the outer arc arch truss sides, a=182.4219, b=276.7871, c=326.1791, are each filled in with a rigid, light-weight plastic material and machined to the arc curve of the outer hull along its outer arch truss edge and machined to the arc curve of the inner hull along its inner arch truss edge for respective panels A and B.

Four different casting plates are formed to prepare panels A and B. Plate (p1) has a concave top surface machined to the arc curve of the outer hull of the sphere. Plate (p2) has a convex bottom surface machined to the arc curve of the outer hull or surface of the sphere, and a concave top surface machined to the arc curve of the inner hull of the sphere, with a cavity in the center of the plate being the negative of panel template (At). Plate (p3) has a convex bottom surface machined to the arc curve of the inner hull of the sphere. Plate (p4) has a convex bottom surface machined to the arc curve of the outer hull of the sphere, and a concave top surface machined to the arc curve of the inner hull of the sphere, with a cavity in the center of the plate being the negative of panel template (Bt).

Panel A is formed preferably by casting as shown in FIGS. 18-21, and 27. Panel B is preferably formed by the same procedure, as shown in FIGS. 22-25 and 28. Casting plate ap2 is seated onto casting plate ap1, and a polymer impregnated carbon fiber, or other suitable material is then wrapped around panel A vacuum bladder Avb and fitted into the casting mold plate ap2. A vacuum tube vt2 (FIG. 34) is then connected to the vacuum bladder Avb with tube vt2 passing through a vacuum port v2 in plate ap3. As shown in FIG. 36 for Panel A, plate ap3 is then lowered into place to seat on ap2 and then all three plates are locked together, sealing the vacuum bladder and casting material inside. Negative pressure is then applied to the vacuum ports v1, v2 and v3 allowing positive pressure down into the vacuum bladder Avb through the vacuum tube vt2, thus expanding bladder Avb and forcing the casting material tight to the inside of the casting cavity. The casting plates are then heated to the curing temperature of the polymer. Once cured, the vacuum bladder is decompressed, the casting plates are then separated and panel A is removed from casting plate ap2 in the direction of plate ap1. The panel casting is then complete.

Panel A is transferred to the cutting station where access holes (12 and 14) as seen in FIG. 42, are then cut into the inner hull and the arch truss sides, and the vacuum bladder is then removed. At this stage the panel is conducted to an insulation station, where insulation is sprayed onto the inside surface of the outer hull and then to a station where mechanicals can be added, such as ventilation ducts, fluid supplies and returns, and electrical wiring.

As shown in FIGS. 22-25, and 28, panel B is cast using casting plate bp4 which is seated onto casting plate bp1, a polymer-impregnated carbon fiber or other suitable material is then wrapped around panel B vacuum bladder Bvb and fitted into the casting mold plate bp4. Vacuum tube vt2 is then connected to the vacuum bladder Bvb, with tube vt2 passing through vacuum port v2 in plate bp3. Plate bp3 is lowered into place seating onto plate bp4, and all three plates are locked together sealing the vacuum bladder and casting material inside, see FIG. 28. Negative pressure is applied to the vacuum ports v1, v2, v3 allowing positive pressure down into the vacuum bladder through tube vt2, expanding the bladder and forcing the casting material tight to the inside of the casting cavity. The casting plates are then heated to the curing temperature of the polymer. Once the polymer has cured, the vacuum bladder is decompressed, the casting plates are separated and panel B is removed from casting plate bp4 in the direction of plate bp1. The panel is conducted to a cutting station where access holes (12 and 14), FIG. 43, are cut into the inner hull and arch truss sides, the vacuum bladder is removed. At this stage the panel is ready for any additional modifications. If required, the panel is transferred to an area where insulation is sprayed onto the inside surface of the outer hull. If desired, mechanicals can be added, such as ventilation ducts, fluid supplies, returns and electrical wiring.

Casting plates ap3, bp3. are identical. Likewise, casting plates ap1, bp1, are identical.

The arch trusses used for the templates are preferably formed from a conventional rigid material which can be reinforced, if need be, so the trusses maintain dimensional stability and do not change shape when used in casting the mold plates. Such a rigid material can include structural plastic, carbon fiber, fiberglass, polycarbonate and the like.

The arch trusses are formed based on two formulas which describe a dodecahedron inscribed in a sphere: (1) $r_u=a/4(\sqrt{5}+\sqrt{3})$ and formula (2) $r_m=a/4(3+\sqrt{5})$, wherein $r_u$ is the radius of the outer hull, $r_m$ is the radius of the inner hull and (a) is the length of one side of a regular pentagon.

As illustrated in FIGS. 1-4 the circumference of the great circle 1 and the outer hull or shell of the sphere, have the same arc curve as the outer arc of the arch trusses. Line (3, 4) represents one side of pentagon 2 with vertex point 3 and vertex point 4 on the great circle parallel to the diameter of the great circle. Inner circle 5 has the same arc curve as the inner hull and the inner arc curve of the arch trusses. Zenith point 5*z* of inner circle 5 is tangent to the center point of line (3, 4). Axis point 1*c* of inner circle 5 is the same as the axis point of the great circle 1. Projecting a radial line from the axis 1*c* to the zenith point 9*z* of the great circle 1 provides the first radial line of arch truss a, which is the radial line segment (9*z*, 5*z*). See FIG. 4 The radial line projected to point 4 on line (1*c*, 4) provides a second radial line of arch truss a, and the first radial line of arch truss c. Projecting a circle 6 with its axis point at 4 and tangent to the center point 7*c* of the pentagon, a radial line 1*c*, 8*t*, is further projected onto the great circle to point 8, which provides the second radial line for arch truss c and the first radial line for arch truss b. The radial line projected from axis point 1*c* along the diameter of the great circle to point 10 on the great circle provides the second radial line for arch truss b, thus forming the proportional dimensions of arch trusses a, b, and c. Attaching these arch trusses together along their radial line edges forms arch truss triangle A. To form arch truss triangle B, identical arch trusses a, b and c, are rotated 180° and joined along their radial line edges thus forming arch truss triangle B, the mirror image of arch truss triangle A.

As illustrated in FIGS. 12-17 arch truss triangles are formed from arch trusses a, b, and c, assembled along their radial line edges 4, 8, 10 to form arch truss triangle A having sides Aa, Ab, Ac, and its mirror image, arch truss triangle B, having sides Ba, Bb, Bc (FIG. 12). Arch truss triangle A and arch truss triangle B, are then seated onto a concave surface that has been treated with a form release lubricant and has the same arc curve as that of the outer hull. The arch truss triangles are then filled with a rigid lightweight plastic material that is tooled to the arc curve of the inner hull along its screed edge to form solid panel templates At and Bt, see FIG. 15. These panel templates are used for forming casting plates ap2 and bp4, respectively.

To make egress portals in the dome structure, panels A and B are adapted to except door hardware. To make skylight portals panels A and B are replaced with transparent or translucent panels of the same dimensions As exemplified in FIGS.18-20 for panel A, casting mold plate ap1 is made of a conventional material for casting mold plates, with top surface A1 machined and polished to a concave arc radius identical to that of the outer hull.

Casting mold plate ap3 is made of a conventional material for casting mold plates, with bottom surface B3 machined and polished to a convex arc radius identical to that of the inner hull. Casting mold plate ap2 is made of a conventional material for making casting mold plates.

Panel template At (FIG. 15) is centered with its outer arc truss edges resting on the surface of casting mold plate ap1, which has been treated with a form release lubricant. A casting form band CFB (shown in FIG. 24), that has also been treated with a form release lubricant is set around the circumference edge of casting mold plate ap1, extending a distance above the surface of plate apt to the inner arc curve of the panel template At. Then cast-forming material is poured into the casting form and is machined to be smooth with a tool that has the same arc curve as the inner hull along the screed edge of the casting form band and the screed edge of the panel template At.

As seen in FIGS. 22-24, for panel B, casting mold plate bp4 is made of a conventional material for making casting mold plates. Panel template Bt is centered with its outer arch truss edges resting on the concave surface of casting mold plate bp1 which has been treated with a form release lubricant. A casting form band (CFB) that has been treated with a form release lubricant is set around the circumference edge of casting mold plate bp1, extending a distance above the surface of plate bp1 to the inner arc curve of the panel template Bt. Cast forming material is poured into the casting form and machined smooth with a tool that has the same arc curve of the inner hull along the screed edge of the casting form band and the screed edge of panel template Bt.

As shown in FIGS. 18-20, the first casting mold plate for panel A, plate ap1, has a concave top surface side A1 with a radius arc identical to that of the sphere or outer hull. The second casting plate for panel A is plate ap2 which is convex and has the curvature radius arc of the outer hull on side A2, and is seated on the first plate ap1. Plate side B2 has a concave surface radius arc identical to the inner hull radius. The thickness of plate ap2 is directly proportional to the radius arc of the outer hull and the radius arc of the inner hull. Plate ap3 side B3 has a convex surface radius arc identical to that of the inner hull, and is seated on the concave surface side B2 of plate ap2.

Triangular panel A is cast using plates ap1, ap2 and ap3, see FIGS. 18-21. Triangular panel B is cast using plates bp1, bp4 and bp3, see FIGS. 22-25. Casting plates ap1 and bp1 are identical plates. Casting plates ap3 and bp3, are identical plates, the letter in front of plate p3 identifies the panel being cast.

The vacuum bladders are made from a balloon-type material that is flexible as well as expandable. The vacuum bladders are the same size and shape when expanded as the casting cavity in the casting plate in which they are to be used in the casting of panels FIGS. 26-28.

When assembling the dome-like structure, arch truss sides (a, b, c) of panels A and B only line up with like lettered sides. Side (a) only lines up with an (a) arch truss side, (b) only lines up with a (b) arch truss side and (c) only lines up with a (c) arch truss side. A-1 panel modules are made up of only A panels. B-1 panel modules are only made up of B panels.

Foundation footing portals are only used in sphere applications and do not require panels A and B, see drawings FIGS. 39, 40 and 41. As seen in FIGS. 38 and 39 when skylight, egress or sphere foundation footing portals are employed, panels A and B are substituted at the required locations by the appropriate portal panel of the same dimensions.

As shown in FIGS. 42 and 43 mechanicals and/or insulation for the above dome structure can also be installed during or after construction through access holes 12 on the inner hull, which also provide access to the threaded grommet system shown in FIGS. 33 and 34 for connecting the panels together. The access holes 12 in the inner hull have cover plates 13 that match the synclastic curve of the inner hull. Since a panel module can only be used with its mirror image, rapid final assembly of the structure is possible.

As shown in FIG. 42 arch truss 11*a* connecting outer hull 1*a* to inner hull 5*a* has access holes 14, while the inner hull 5*a* of Panel A has access holes 12 with matching cover plates 13. In FIG. 43 for Panel B outer hull 1*b* is connected to inner hull 5*b* via arch truss 11*b* which has access holes 14 Inner hull 5*b* has access holes 12 coverable by synclastic access covers 13.

Other modifications will be obvious to those skilled in this art. The invention is not to be limited except as set forth in the following claims. in plate ap3. As shown in FIG. 36 for Panel A, plate ap3 is then lowered into place to seat on ap2 and then all three plates are locked together, sealing the vacuum bladder and casting material inside. Negative pressure is then applied to the vacuum ports v1, v2 and v3 allowing positive pressure down into the vacuum bladder Avb through the vacuum tube vt2, thus expanding bladder Avb and forcing the casting material tight to the inside of the casting cavity. The casting plates are then heated to the curing temperature of the polymer. Once cured, the vacuum bladder is decompressed, the casting plates are then separated and panel A is removed from casting plate ap2 in the direction of plate ap1. The panel casting is then complete.

Panel A is transferred to the cutting station where access holes (12 and 14) as seen in FIG. 42, are then cut into the inner hull and the arch truss sides, and the vacuum bladder is then removed. At this stage the panel is conducted to an insulation station, where insulation is sprayed onto the inside surface of the outer hull and then to a station where mechanicals can be added, such as ventilation ducts, fluid supplies and returns, and electrical wiring.

As shown in FIGS. 22-25, and 28, panel B is cast using casting plate bp4 which is seated onto casting plate by 1, a polymer-impregnated carbon fiber or other suitable material is then wrapped around panel B vacuum bladder Bvb and fitted into the casting mold plate bp4. Vacuum tube vt2 is then connected to the vacuum bladder Bvb, with tube vt2 passing through vacuum port v2 in plate bp3. Plate bp3 is lowered into place seating onto plate bp4, and all three plates are locked together sealing the vacuum bladder and casting material inside, see FIG. 28. Negative pressure is applied to the vacuum ports v1, v2, v3 allowing positive pressure down into the vacuum bladder through tube vt2, expanding the bladder and forcing the casting material tight to the inside of the casting cavity. The casting plates are then heated to the curing temperature of the polymer. Once the polymer has cured, the vacuum bladder is decompressed, the casting plates are separated and panel B is removed from casting plate bp4 in the direction of plate bp1. The panel is conducted to a cutting station where access holes (12 and 14), FIG. 43, are cut into the inner hull and arch truss sides, in plate ap3. As shown in FIG. 36 for Panel A, plate ap3 is then lowered into place to seat on ap2 and then all three plates are locked together, sealing the vacuum bladder and casting material inside. Negative pressure is then applied to the vacuum ports v1, v2 and v3 allowing positive pressure down into the vacuum bladder Avb through the vacuum tube vt2, thus expanding bladder Avb and forcing the casting material tight to the inside of the casting cavity. The casting plates are then heated to the curing temperature of the polymer. Once cured, the vacuum bladder is decompressed, the casting plates are then separated and panel A is removed [form] from casting plate ap2 in the direction of plate ap1. The panel casting is then complete.

Panel A is transferred to the cutting station where access holes (12 and 14) as seen in FIG. 42, are then cut into the inner hull and the arch truss sides, and the vacuum bladder is then removed. At this stage the panel is conducted to an insulation station, where insulation is sprayed onto the inside surface of the outer hull and then to a station where mechanicals can be added, such as ventilation ducts, fluid supplies and returns, and electrical wiring.

As shown in FIGS. 22-25, and 28, panel B is cast using casting plate bp4 which is seated onto casting plate bp1, a polymer-impregnated carbon fiber or other suitable material is then wrapped around panel B vacuum bladder Bvb and fitted into the casting mold plate bp4. Vacuum tube vt2 is then connected to the vacuum bladder Bvb, with tube vt2 passing through vacuum port v2 in plate bp3. Plate bp3 is lowered into place seating onto plate bp4, and all three plates are locked together sealing the vacuum bladder and casting material inside, see FIG. 28. Negative pressure is applied to the vacuum ports v1, v2, v3 allowing positive pressure down into the vacuum bladder through tube vt2, expanding the bladder and forcing the casting material tight to the inside of the casting cavity. The casting plates are then heated to the curing temperature of the polymer. Once the polymer has cured, the vacuum bladder is decompressed, the casting plates are separated and panel B is removed from casting plate bp4 in the direction of plate bp1. The panel is conducted to a cutting station where access holes (12 and 14), FIG. 43, are cut into the inner hull and arch truss sides,

What is claimed is:

1. A synclastic building panel and its mirror image panel, adapted to form an element of a dome structure comprising: a synclastic triangular outer hull; a synclastic triangular inner hull proportional to the outer hull; and arch truss sides connecting a periphery of the inner hull to a periphery of the outer hull to provide an integral cast seamless hollow core panel structure, wherein each said panel structure has the dihedral angles,(a), (b) and (c), and wherein angle (a) is 34°26'11.49", angle (b) is 58°24'8.46" and angle (c) is 87°9'40.05".

2. A synclastic building module and its mirror image module adapted to form an element of a dome structure comprising: first and second synclastic building panels, each said building panel comprising a synclastic triangular outer hull; a synclastic triangular inner hull proportional to the outer hull; and arch truss-sides connecting a periphery of the inner hull to a periphery of the outer hull to provide an integrated cast seamless hollow core panel structure, wherein each building module is joinable symmetrically to its mirror image module along congruent arch truss sides and wherein each said building module has the same three dihedral angles, (a), (b) and (c) and wherein angle (a) is 34°26'11.49", angle (b) is 58°24'8.46" and angle (c) is 87°9'40.45".

3. A synclastic dome structure comprising: a plurality of joined symmetrically, synclastic triangular shaped building modules, each building module comprising a set of building panels, A panels for A modules and B panels for B modules which are mirror images of each other, each said panel A and B comprises (a) a synclastic triangular outer hull surface, (b) synclastic triangular inner hull surface and (c) arch truss sides seamlessly connecting periphery of the inner hull surface to a periphery of the outer hull surface to form an integrated cast seamless hollow core panel structure, wherein each set of building panels are joined symmetrically along congruent arch truss sides of respective modules, wherein, each said building module and building panel have dihedral angles (a), (b), and (c), wherein angle (a) is 34°26'11.49", (b) is 58°24'8.46" and (c) is (87°9'40.05".

4. The panel of claim 1, wherein the panel structure has a centrally spaced oculus in the inner hull having a cover plate.

5. The module of claim 2, wherein the panel structure has a centrally spaced oculus in the inner hull having a cover plate.

6. The dome structure of claim 3 wherein the building panel has a centrally spaced oculus in the inner hull having a cover plate.

* * * * *